US006257952B1

(12) United States Patent
Valentin

(10) Patent No.: US 6,257,952 B1
(45) Date of Patent: Jul. 10, 2001

(54) STRAPLESS AND BACKLESS BRA

(75) Inventor: Tara J. Valentin, Albany, NY (US)

(73) Assignee: Imagine Enterprises LLC, Cairo, NY (US)

( * ) Notice: Subject to any disclaimer, the term of this patent is extended or adjusted under 35 U.S.C. 154(b) by 0 days.

(21) Appl. No.: 09/635,168

(22) Filed: Aug. 9, 2000

Related U.S. Application Data

(63) Continuation-in-part of application No. 09/243,397, filed on Feb. 1, 1999.

(51) Int. Cl.[7] ..... A41C 31/00
(52) U.S. Cl. ..... 450/81; 450/1
(58) Field of Search ..... 450/1, 81, 82, 450/83, 88, 57, 53–56, 40, 41, 43, 45; 2/267

(56) References Cited

U.S. PATENT DOCUMENTS

| | | | |
|---|---|---|---|
| D. 419,279 | | 1/2000 | Marco et al. . |
| 2,079,426 | | 5/1937 | Schottenfels . |
| 2,579,546 | * | 12/1951 | Cadous ..... 450/81 |
| 3,196,460 | | 7/1965 | Halstead . |
| 3,221,748 | | 12/1965 | Glasser . |
| 3,276,449 | | 10/1966 | Morgan . |
| 3,556,107 | | 1/1971 | Brumfield . |
| 3,749,102 | | 7/1973 | Wynants . |
| 3,934,593 | | 1/1976 | Mellinger . |
| 4,343,313 | | 8/1982 | Le Jeune . |
| 4,553,550 | | 11/1985 | Hattori . |
| 4,992,074 | | 2/1991 | Diaz . |
| 5,755,611 | | 5/1998 | Noble et al. . |

* cited by examiner

*Primary Examiner*—Gloria M. Hale
(74) *Attorney, Agent, or Firm*—Hoffman, Warnick & D'Alessandro LLC; Ronald A. D'Alessandro

(57) ABSTRACT

A strapless and backless bra is provided that can be worn with backless or revealing clothing. The bra includes a first and a second cup each having: 1) an open top end; 2) a closed bottom end; 3) an outer side and an inner side each having substantially parallel upper portions; and 4) a tab, positioned proximate the outer side of the cup. The upper portions of the inner sides of each cup are directly connected/joined together. In addition, the bra may include a rigid underwire/supporter and a rigid reinforcement member for enhancing the appearance of a user's breasts while providing uniform lift and support.

13 Claims, 6 Drawing Sheets

STRAPLESS AND BACKLESS BRA

CONTINUING APPLICATION DATA

This Application is a Continuation-in-Part of copending U.S. application Ser. No. 09/243,397, filed Feb. 1, 1999 and entitled STRAPLESS AND BACKLESS BRA, herein incorporated by reference.

BACKGROUND OF THE INVENTION

1. Technical Field

The present invention generally relates to a strapless and backless bra, and more particularly, to a strapless and backless bra for providing uniform lift and support and enhanced appearance of the breasts of a user.

2. Background Art

In the production of undergarments, a bra is often required that can be worn with backless, low cut, or other revealing garments. For example, when a backless dress is worn, a bra is required that cannot be seen by others while still maintaining uniform lift and support for the user's breasts.

Heretofore, many have attempted to solve this problem by employing inferior variations. Examples include the following, all of which are herein incorporated by reference:

U.S. Pat. No. 2,079,426 to Schottenfels teaches a supporting garment having two cups and a plurality of heads onto which adhesive is placed. The bra of Schottenfels is inferior because, inter alia, the orientation of the cups and the placement of the adhesive heads along the top of the cups cause the bra to be exposed when worn with a low cut or similar revealing garment.

U.S. Pat. No. 4,992,074 to Diaz, U.S. Pat. No. 3,934,593 to Mellinger, and U.S. Pat. No. 5,755,611 to Noble et al. all teach a bra comprised of two separate cups having adhesive positioned along the periphery thereof. With bras having two separate cups, however, a number of problems become apparent. For example, a user will not have uniformity in lift and support of both breasts. In contrast, bras having two separate cups can only lift and support the breasts as individual units, leading to a unevenness or distortion in the lift, support, and overall appearance of the user's breasts. In addition, Diaz, Mellinger and Noble et al. all teach the use of adhesive over a large part of the user's breasts. Such a teaching leads to unnecessary discomfort in both the application and removal of the bra. Moreover, instead of being U-shaped, the cups of these related devices flare outward near their top portions. This configuration leads to decreased lift and support of a user's breasts while giving the breasts an undesired or unflattering shape.

Therefore, there exists the need for a strapless and backless bra that can be worn with revealing clothing while lifting and supporting the breasts of a user with uniformity and comfort.

SUMMARY OF THE INVENTION

The present invention overcome's the deficiencies of the related art by including a strapless and backless bra that will lift and support the breasts of a user with uniformity and comfort while optimizing breast appearance. According to one aspect of the present invention, a strapless and backless bra is provided. The bra comprises: (a) a first cup and a second cup, wherein each cup includes: (1) an open top end, (2) a closed bottom end, (3) an outer side and an inner side each having substantially parallel upper portions, and (4) a tab, positioned proximate the outer side; and (b) wherein the upper portion of the inner side of the first cup is directly contacted with to the upper portion of the inner side of the second cup.

According to another aspect of the present invention, a strapless and backless bra is provided. The bra comprises: (a) a first cup having an inner side, an outer side, an open top end, a closed bottom end and a tab positioned proximate the outer side, wherein the inner side and the outer side each have an upper portion that are substantially parallel to each other; (b) a second cup having an inner side, an outer side, an open top end, a closed bottom end and a tab positioned proximate the outer side, wherein the inner side and the outer side each have an upper portion that are substantially parallel to each other; and (c) wherein the upper portion of the inner side of the first cup is directly contacted with the upper portion of the inner side of the second cup.

It is therefore an advantage of the present invention to provide a strapless and backless bra for lifting and supporting the breasts of a user with uniformity and comfort.

The preferred embodiment of the invention is designed to solve the problems herein described and other problems not discussed, which are discoverable by a skilled artisan.

BRIEF DESCRIPTION OF THE DRAWINGS

These and other features and advantages of this invention will be more readily understood from the following detailed description of the various aspects of the invention taken in conjunction with the accompanying drawings in which.

Figure 1:
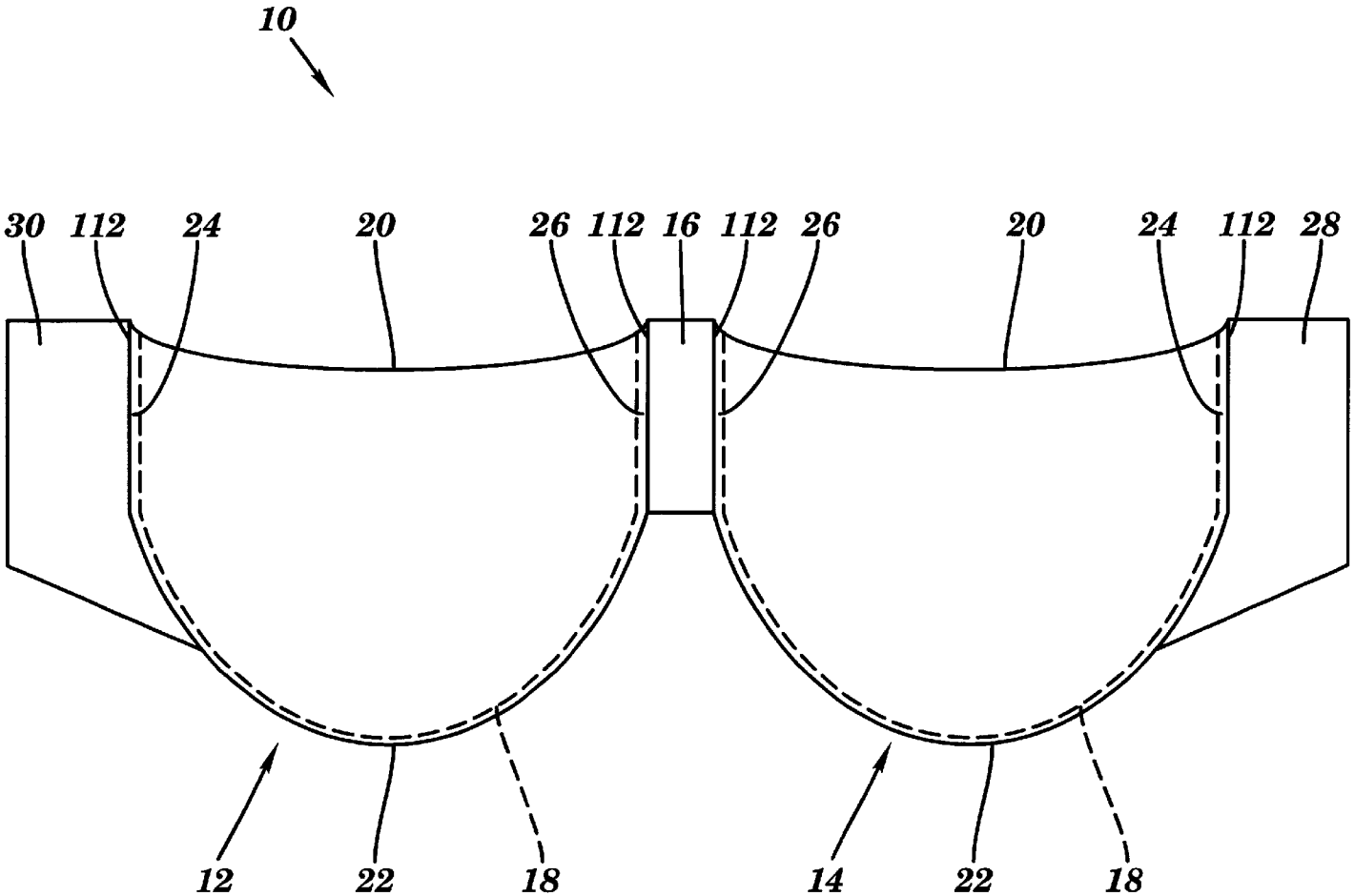
FIG. 1 is a front view of a strapless and backless bra in accordance with a first embodiment of the present invention.

It is noted that the drawings of the invention are not necessarily to scale. The drawings are merely schematic representations, not intended to portray specific parameters of the invention. The drawings are intended to depict only typical embodiments of the invention, and therefore should not be considered as limiting the scope of the invention. In the drawings, like numbering represents like elements between the drawings.

DETAILED DESCRIPTION OF THE PREFERRED EMBODIMENTS

Figure 2:
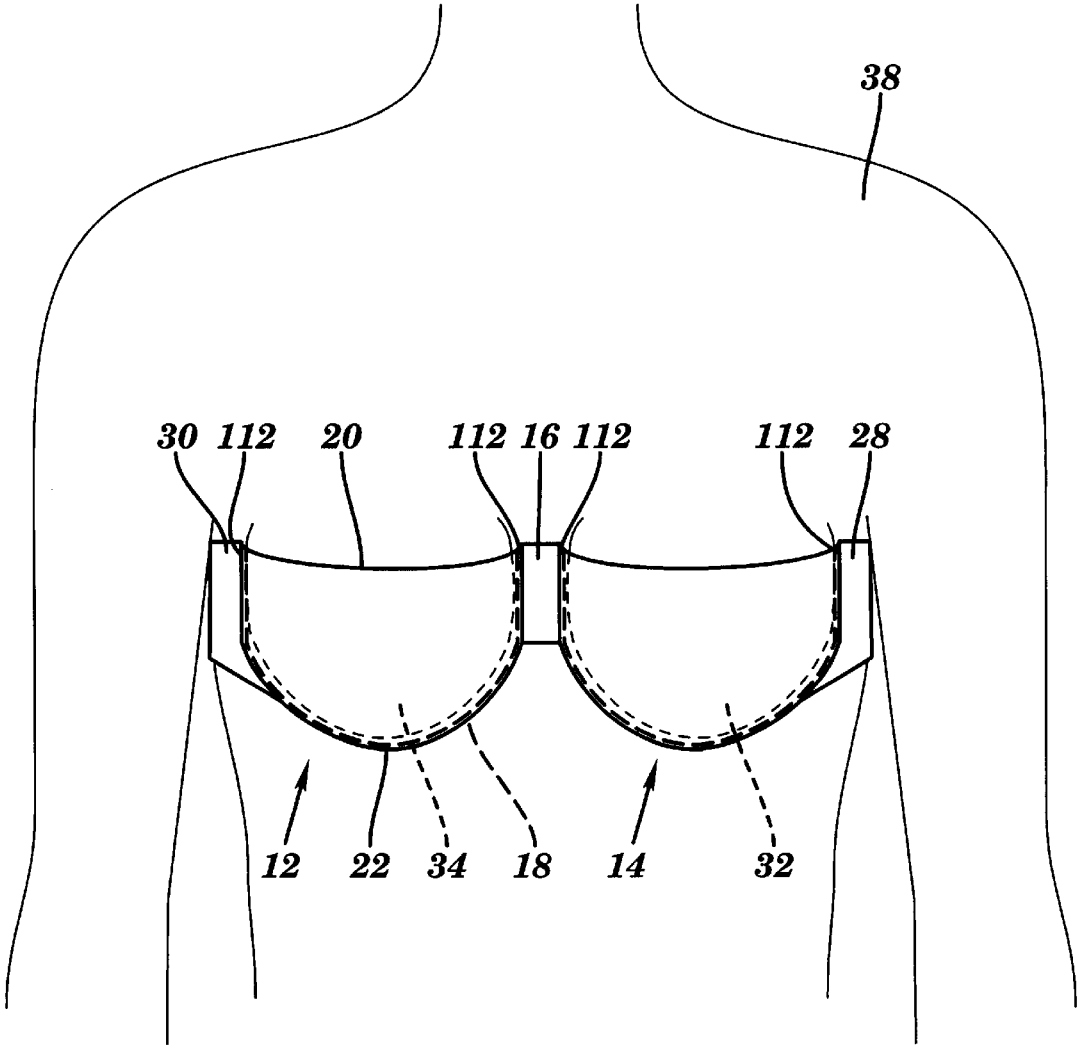
FIG. 2 is a front view of the first embodiment of the present invention when placed on a user.

Referring now to the drawings, FIGS. 1 and 2 depict a first embodiment of a strapless and backless bra in accordance with the present invention. As shown, bra 10 includes U-shaped cups 12 and 14, which are connected by bridge connector 16.

U-shaped cups 12 and 14 each have an outer side 24, an inner side 26, an open top end 20, and a closed bottom end 22. As shown in FIGS. 1 and 2 cups 12 and 14 are U-shaped with the upper portions 112 of the outer sides 24 and the inner sides 26 thereof all being substantially parallel to each other to provide optimal lift and support for user 38. This is in contrast to related bras where the cups flare outward, which provide less lift and support for the user 38. The bra 10 is preferably constructed from a soft woven or knitted fabric, such as cotton and/or lace. However, it should be understood that many equivalent alternatives for material exist.

Each cup 12 and 14 of the bra 10 may also include an underwire or supporter 18 that is positioned along the periphery of the cups 12 and 14. Specifically, the underwire 18 is formed from a rigid material and extends along each cup, in a U-shaped configuration, along the outer side 24, the closed bottom end 22 and the inner side 26. The underwire or supporter 18 aids in the lifting and supporting of the user's breasts 32 and 34 and, although it is not necessary for every user 38, large breasted women may prefer it. Examples of rigid material that could be used as an underwire 18 include, inter alia, metal or plastic. However, it should be appreciated that many other equivalents exist that could be used as an underwire 18.

Figure 7:
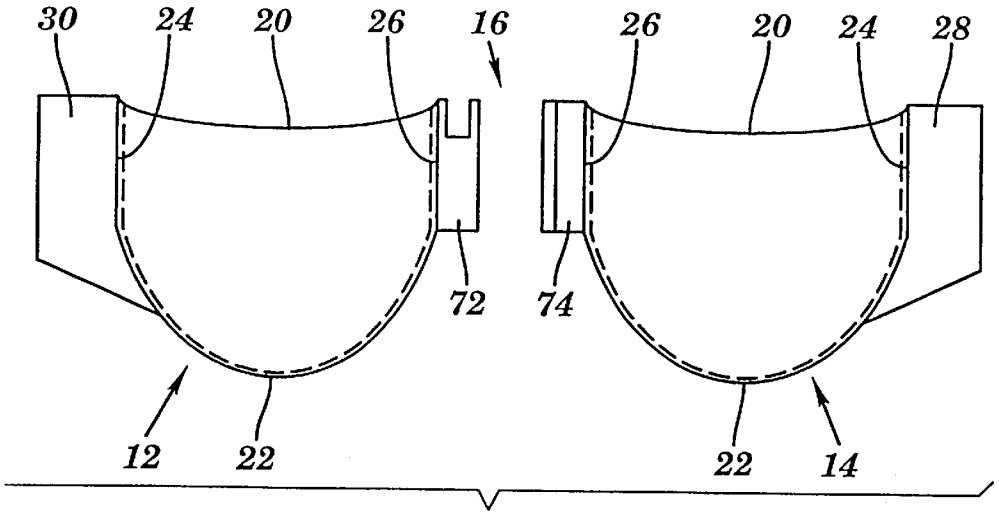
FIG. 7 is a front view of a releasable snap-fit connector in accordance with the present invention.

Bridge connector 16 represents any form of connection between the U-shaped cups 12 and 14, such as a unitary piece of material, as shown. However, it should be appreciated that many equivalent alternatives exist. For example, bridge connector 16 could be, inter alia, a releasable snap-fit connector 16, an eye and hook connector, or a system for joining the inner sides 26 of the U-Shaped cups 12 and 14 together (such as stitching shown in FIG. 8). FIG. 7, depicts the U-shaped cups 12 and 14 joined together by a releasable snap-fit connector 16. As shown, the releasable snap-fit connector 16 has complementary snap-like female 72 and male 74 interconnections positioned proximate each inner side 26. To join the U-shaped cups 12 and 14 together, the user would snap male interconnection 74 into complementary female interconnection 72 after the individual U-shaped cups 12 and 14 have been attached to the user's 38 body.

Opposing tabs 28 and 30 are provided and are positioned proximate the outer sides 24 of the cups 14 and 12, respectively. As show in FIG. 2, the tabs 28 and 30 are adhered only to the outer sides of the body 32 and 34 of the user 38. This positioning of the tabs 28 and 30 reduces the surface area of the bra 10 that must be adhered to the user's 38 body and allows for the bra to remain hidden when worn with revealing clothing. In addition, the placement of the tabs provides for optimal lift, support, and appearance of the user's 38 breasts 32 and 34.

Figure 6:
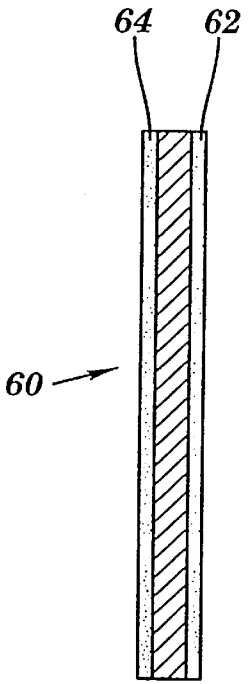
FIG. 6 is a side view of an adhesive tape of the present invention.

Adhesion of the bra 10 to the user 38 is preferably accomplished using a two sided tape 60. As depicted in FIG. 6, two sided generally includes a body side adhesive 62 on one side and a fabric side adhesive 64 on the other side. Body side adhesive 62 is preferably a hypoallergenic, pressure sensitive, acrylate adhesive that is non-toxic and reduces irritation of the skin of a user 38. Fabric side adhesive 64 is preferably a random oriented polyester fiber in a hypoallergenic, pressure sensitive, acrylic adhesive that will optimize adhesion of the two sided tape 60 to the tabs 28 and 30 of the bra 10. This specific two sided tape 60 having the cited body side adhesive 62 and fabric side adhesive 64 is available from 3M Corp. of St. Paul, Minn. Although a preferred compound has been cited for both adhesives, it should be appreciated that many equivalents exist.

To be worn, the user 38 places one piece/segment of the two sided tape 60 in contact with each of the tabs 28 and 30. Specifically, the fabric side adhesive 64 of each segment of the two sided tape 60 is placed onto the back surface of each of the tabs 28 and 30. Once the two sided tape 60 is firmly adhered to each of the tabs 28 and 30, the bra may then be adhered to the user 38. This is accomplished by placing the body side adhesive 62 of tab 28 in contact with the outer side of a user's 38 body proximate the armpit. Then, the bra 10 is pulled and/or stretched across the user's 38 body until the body side adhesive 62 of the other tab 30 is placed in contact with, and is adhered to, the outer side of the user's 38 body proximate the other armpit. This example is given for illustration purposes only and not intended to be limiting. For example, a user can apply tab 30 first and then tab 28.

It should be appreciated that the tabs 28 and 30 could have a heat sealable polyethylene or other similar film (not shown) bonded to the back surface thereof. The film would be disposed between the back surface of the tabs 28 and 30 and the two sided tape 60. Such a film would facilitate the release of the two sided tape 60 from the tabs 28 and 30 and eliminate the need for having a two sided tape 60 with two different adhesives. For example, the two sided tape 60 could have body side adhesive 62 on both sides.

The combination of: (1) tabs that adhere only to the outer side of the user's body; (2) two U-shaped cups that are connected/joined together; and (3) an underwire or supporter, when used, optimizes the lift, support, and appearance of the user's 38 breasts 32 and 34 while still allowing for the user 38 to wear backless or similar revealing clothing. Specifically, the placement of the tabs 28 and 30 along only the outer sides of the user's body 38 allow the bra 10 to be positioned such that the top portions of the breasts 32 and 34 can be exposed through the open top ends 20 of the cups 12 and 14 while not exposing any part of the bra 10. Also, the placement of the tabs 28 and 30 allows breasts 32 and 34 to be uplifted while being pulled inward towards the center of the user's 38 body.

Similarly, the U-shaped cups 12 and 14 and the underwire/supporter 18, when used, lift the user's 38 breasts 32 and 34 while pulling them inward to give the breasts 32 and 34 a uniform and flattering shape along with the appearance of increased size.

Figure 3:
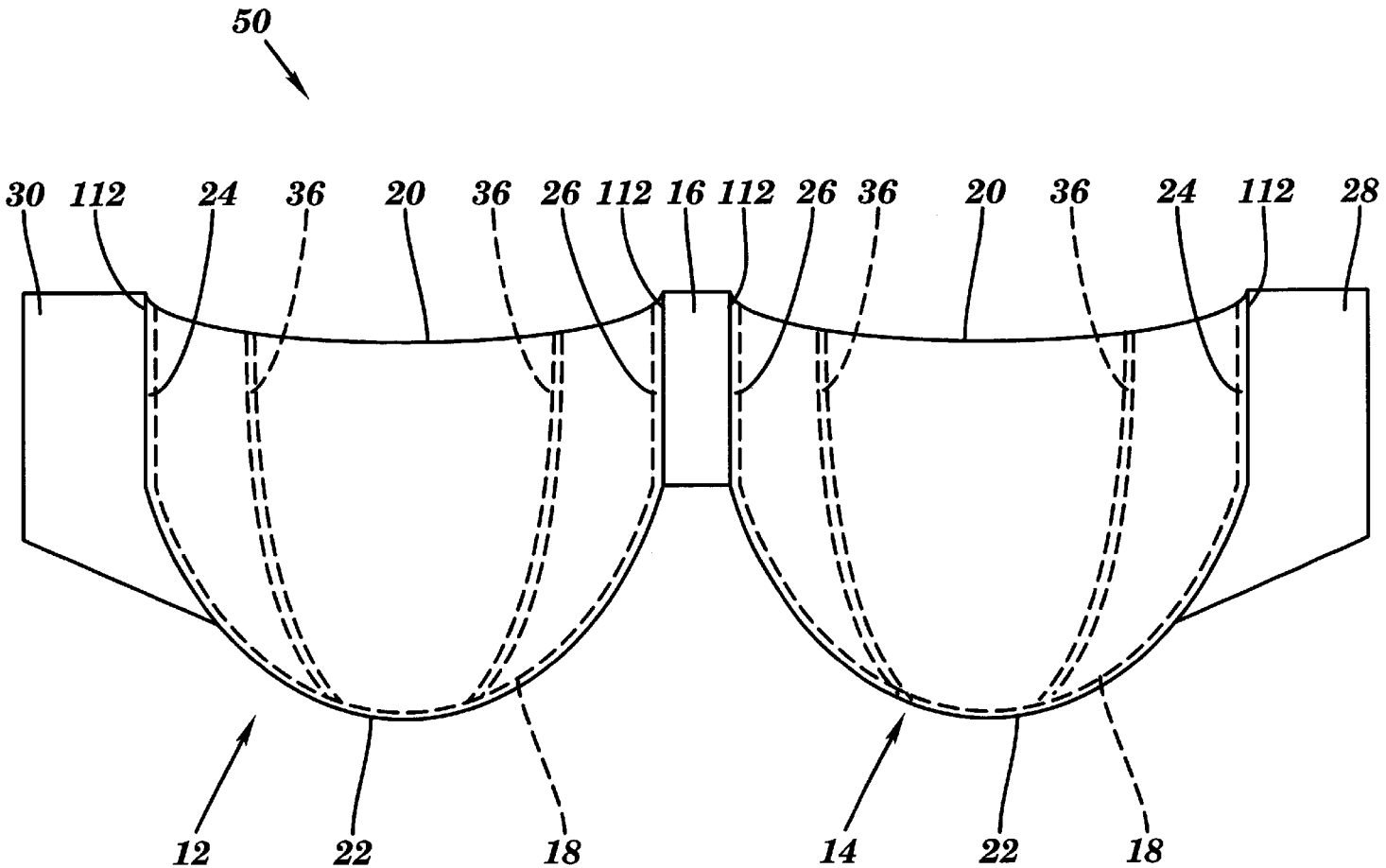
FIG. 3 is a front view of a strapless and backless bra in accordance with a second embodiment of the present invention.

FIG. 3 shows a second embodiment of a strapless and backless bra 50 in accordance with the present invention. Specifically, bra 50 is provided and includes U-shaped cups 12 and 14 that are connected/joined together. As shown in FIG. 3, U-shaped cups 12 and 14 are joined together by a bridge connector 16.

Also similar to the bra 10 of the first embodiment, each cup 12 and 14 of the bra 50 has: (1) an inner side 26; (2) an outer side 24; (3) an open top end 20; (4) a closed bottom end 22; and (5) a tab 28 or 30, positioned proximate to the outer side 24. Bra 50 may also include an underwire or supporter 18 formed from a rigid material, such as plastic, metal, or other similar equivalent. As shown in the FIG. 3, the cups 12 and 14 are U-shaped with the upper portions 112 of the outer sides 24 and the inner sides 26 being substantially parallel to each other to provide optimal lift and support for the user's 38 breasts 32 and 34. This is in contrast to related bras, in which the cups flare outward, thus, giving less lift and support to a user.

The bra 50 is also preferably constructed from a soft woven or knitted fabric, such as cotton and/or lace. However, it should be understood that many equivalent alternatives for material exist.

Bridge connector 16 represents any form of connection between the U-shaped cups 12 and 14, such as a unitary piece of material, as shown. However, it should be appreciated that many equivalent alternatives exist. For example, bridge connector 16 could be, inter alia, a releasable snap-fit connector, an eye and hook connector, or a system for-joining the inner sides 26 of the U-shaped cups 12 and 14 together. FIG. 7, depicts the U-shaped cups 12 and 14 joined together by a releasable snap-fit connector. As shown, the releasable snap-fit connector 16 has complementary snap-like female 72 and male 74 interconnections positioned proximate each inner side 26. To join the U-shaped cups 12 and 14 together, the user would snap male interconnection 74 into complementary female interconnection 72 after the individual U-shaped cups 12 and 14 have been attached to the user's 38 body.

Bra 50 differs from bra 10 by the inclusion of rigid reinforcement members or boning 36. As shown, rigid reinforcement members 36 are positioned vertically on each of the U-shaped cups 12 and 14, between the outer sides 24 and the inner 26 sides. The role of the rigid reinforcement members 36 is to provide additional lift and support while enhancing the shape of the user's breasts 32 and 34. Rigid reinforcement members 36 are preferably metal or plastic, however it should be understood that many equivalent alternatives exist.

Bra 50 is adhered to a user's body 38 in the same manner as the bra 10 of the first embodiment of the present invention. Specifically, a two sided tape 60 is provided having a body side adhesive 62 on one side and a fabric side adhesive 64 on the other side, as depicted in FIG. 6. Body side adhesive 62 is preferably a hypoallergenic, pressure sensitive, acrylate adhesive that is non-toxic and reduces irritation of the skin of a user 38. Fabric side adhesive 64 is preferably a random oriented polyester fiber in a hypoallergenic, pressure sensitive, acrylic adhesive that will optimize adhesion of the two sided tape 60 to the tabs 28 and 30 of the bra 50. As stated above, although a preferred compound has been cited for both adhesives, it should be appreciated that many equivalents exist.

To apply the bra 50 to the user's body, the user 38 must apply one piece/segment of the two sided tape to the back surface of each tab 28 and 30 with the fabric side adhesive 64 contacting the tab 28 and 30. Then, the bra 50 is applied to the user's 38 body as described in the illustrative example given above.

It should be appreciated that the tabs 28 and 30 could have a heat sealable polyethylene or other similar film (not shown) bonded to the back surface thereof. The film would be disposed between the back surface of the tabs 28 and 30 and the two sided tape 60. Such a film would facilitate the release of the two sided tape 60 from the tabs 28 and 30 and eliminate the need for having a two sided tape 60 with two different adhesives. For example, the two sided tape 60 could have body side adhesive 62 on both sides.

Similar to the first embodiment of the present invention, a combination of features provide optimal lift, support, and appearance of the user'breasts while allowing the user 38 to wear backless or similar revealing clothing. Generally, the features of: (1) tabs that adhere only to the outer sides of the user's body (2) two U-shaped cups that are connected/joined together; (3) rigid reinforcement members; and (4) an underwire or supporter, when used, optimize the lift and support of the user's breasts 32 and 34 while still allowing for the user 38 to wear backless or similar revealing clothing. Specifically, the placement of the tabs 28 and 30 along only the outer sides of the user's 38 body allow the bra 50 to be positioned such that the top portions of the breasts 32 and 34 can be exposed through the open top ends 20 of the cups 12 and 14 while not exposing any part of the bra 50. Also, the placement of the tabs 28 and 30 allows the breasts 32 and 34 to be uplifted while being pulled inward towards the center of the user's 38 body.

Similarly, the U-shaped cups 12 and 14 and the underwire/supporter, when used, lift the user's 38 breasts 32 and 34 while pulling them inward giving the breasts 32 and 34 a uniform and flattering shape along with the appearance of increased size. Finally, the rigid reinforcement members 36 provide additional optimization of breast shape and lift.

Figure 4:
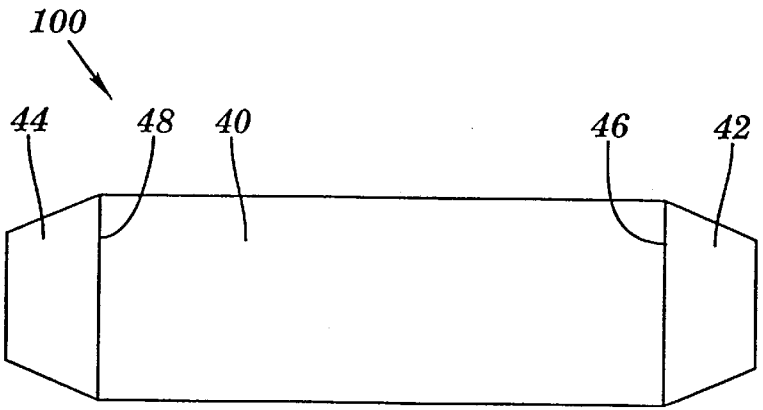
FIG. 4 is a front view of a strapless and backless bra in accordance with a third embodiment of the present invention.
Figure 5:
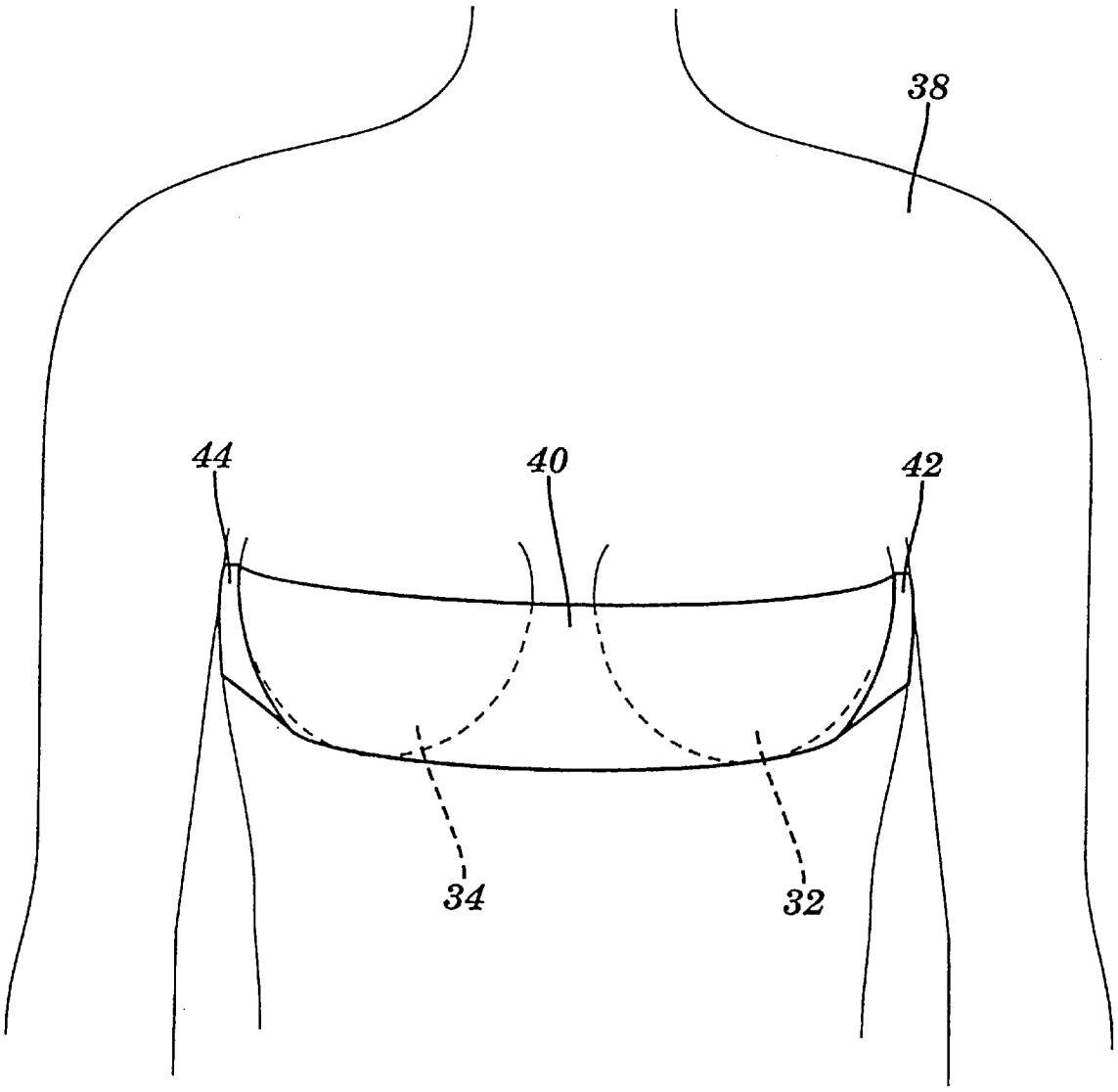
FIG. 5 is a front view the third embodiment of the present invention when placed on a user.

FIGS. 4 and 5 depict a strapless and backless bra in accordance with a third embodiment of the present invention. In particular, bra 100 includes a unitary band of material 40 having opposing ends 46 and 48. A pair of tabs 42 and 44 are affixed to ends 46 and 48, respectively. Similar to the first and second embodiments, the tabs 42 and 44 are constructed from a soft woven or knitted fabric, such as cotton or lace. However, it should be appreciated that many equivalent variations exist which are suitable. The unitary band of material 40 is preferably fashioned from a stretchable fabric, such as lycra or other similar material.

Bra 100 is adhered to a user's body 38 in the same manner as the strapless and backless bras 10 and 50 of the first and second embodiments of the present invention. Specifically, a two sided tape 60 is provided having a body side adhesive 62 on one side and a fabric side adhesive 64 on the other side, as depicted in FIG. 6. Body side adhesive 62 is preferably a hypoallergenic, pressure sensitive, acrylate adhesive that is non-toxic and reduces irritation of the skin of a user 38. Fabric side adhesive 64 is preferably a random oriented polyester fiber in a hypoallergenic, pressure sensitive, acrylic adhesive that will optimize adhesion of the two sided tape 60 to the tabs 42 and 44 of the bra 100. Although a preferred compound has been cited for both the adhesives, it should he appreciated that many equivalents exist.

To apply the bra 100 to the user's body, the user 38 must apply one piece/segment of the two sided tape to the back surface of each tab 42 and 44 with the fabric side adhesive 64 contacting the tab 42 and 44. Then, the bra 100 is applied to the user's 38 body as described in the illustrative example given above.

It should be appreciated that the tabs 42 and 44 could have a heat sealable polyethylene or other similar film (not shown) bonded to the back surface thereof. The film would be disposed between the back surface of the tabs 42 and 44 and the two sided tape 60. Such a film would facilitate the release of the two sided tape 60 from the tabs 42 and 44 and eliminate the need for having a two sided tape 60 with two different adhesives. For example, the two sided tape 60 could have body side adhesive 62 on both sides.

The combination of using a highly stretchable fabric and the particular placement of the tabs 42 and 44 provides optimal lift, support, and appearance of the user's breasts while allowing the user 38 to wear backless or similar revealing clothing. Specifically, the highly stretchable fabric, when pulled across the user's 38 body, allows the breasts 32 and 34 to be snugly lifted and supported as one unit, thus, ensuring uniformity in size and overall appearance of the breasts 32 and 34.

Similarly, the placement of the tabs 42 and 44 along only the outer sides of the user's 38 body allow the bra 10 to be positioned such that the top portions of the breasts 32 and 34 can be exposed over the unitary band of material 40 while not exposing any part of the bra 100. Also, the placement of the tabs 42 and 44 allows the breasts 32 and 34 to be uplifted while being pulled inward towards the center of the user's 38 body.

Figure 8:
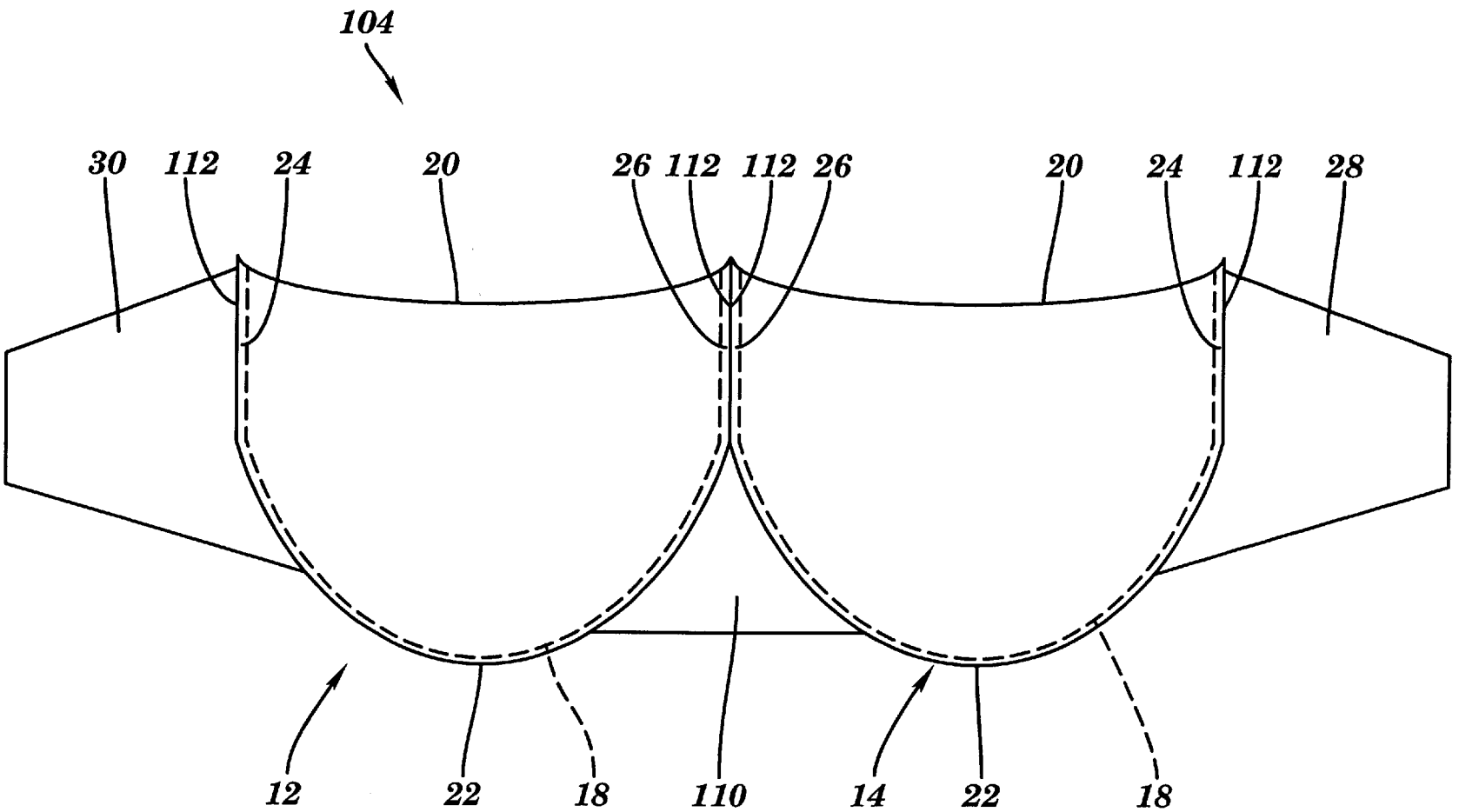
FIG. 8 is a front view of a fourth embodiment of the present invention.

Referring now to FIG. 8, a fourth embodiment of the strapless and backless bra of the present invention is shown. In particular, bra 104 includes U-shaped cups 12 and 14 that each have an outer side 24, an inner side 26, an open top end 20, a closed bottom end 22 and a tab 28 or 30 positioned proximate the outer side. Similar to the previous embodiments, the upper portions 112 of the outer sides 24 and the inner sides 26 are all substantially parallel to each other. As shown in FIG. 8, the upper portions 112 of the inner sides 26 of each cup are both parallel to and directly contacted (abutting) with each other. This direct contact eliminates the need for a bridge connector 16 to indirectly join the upper portions 112 together. Accordingly, a more a rigid and unitary structure is provided that gives increased lift and support to the user.

Preferably, the direct contact is achieved by a cup connector 110 positioned behind the cups (i.e., on the side of the cups that contact the user's breasts), which is stitched or sewn along the inner side 26 of each cup 12 and 14. The direct contact of the cups provides a bra with maximum rigidity that gives the user optimal lift and support. It should be appreciated, however, that other means for directly contacting the upper portions may exist. For example, the upper portions 112 of the inner sides 26 may be glued or otherwise adhesively joined.

As an alternative, the cup connector 110 can be positioned such that the cups 12 and 14 do not directly contact. Accordingly, the cup connector 110 can be considered a bridge connector 16 (as shown in FIG. 1).

It should be understood that the bra 104 of FIG. 8 can also include the supporter(s) 18 and/or reinforcement members 36 shown in FIG. 3. Moreover, similar to the bras of other embodiments, the bra 104 and cup connector 110 are preferably constructed from a soft woven or knitted fabric, such as cotton and/or lace. However, it should be understood that many equivalent alternatives for material exist.

Bra 104 is adhered to a user's body 38 in the same manner as described above with respect to the other embodiments of the present invention. Specifically, a two sided tape 60 is provided having a body side adhesive 62 on one side and a fabric side adhesive 64 on the other side, as depicted in FIG. 6. Body side adhesive 62 is preferably a hypoallergenic, pressure sensitive, acrylate adhesive that is non-toxic and reduces irritation of the skin of the user. Fabric side adhesive 64 is preferably a random oriented polyester fiber in a hypoallergenic, pressure sensitive, acrylic adhesive that will optimize adhesion of the two sided tape 60 to the tabs 28 and 30 of the bra 104. As stated above, although a preferred compound has been cited for both adhesives, it should be appreciated that many equivalents exist.

The user must apply one piece/segment of the two sided tape to the back surface of each tab 28 and 30 with the fabric side adhesive 64 contacting the tab 28 and 30. Then, the bra 104 is applied to the user's body proximate the armpits, as described in the illustrative examples given above.

It should be appreciated that the tabs 28 and 30 could have a heat sealable polyethylene or other similar film (not shown) bonded to the back surface thereof. The film would be disposed between the back surface of the tabs 28 and 30 and the two sided tape 60. Such a film would facilitate the release of the two sided tape 60 from the tabs 28 and 30 and eliminate the need for having a two sided tape 60 with two different adhesives. For example, the two sided tape 60 could have body side adhesive 62 on both sides.

Similar to the previous embodiments of the present invention, a combination of features provide optimal lift, support, and appearance of the user's breasts while allowing the user to wear backless or similar revealing clothing. Generally, the features of: (1) tabs that adhere only to the outer sides of the user's body; (2) two U-shaped cups each having an inner side and (3) an outer side with upper portions that are all substantially parallel to each other; and the direct connection of the upper portions of the inner sides provide the user with maximum lift and support. Additionally, the placement of the tabs 28 and 30 along only the outer sides of the user allow the bra 104 to be positioned such that the top portions of the breasts 32 and 34 can be exposed through the open top ends 20 of the cups 12 and 14 while not exposing any part of the bra 104. Also, the placement of the tabs 28 and 30 allows the breasts 32 and 34 to be uplifted while being pulled inward towards the center of the user's body.

The foregoing description of the preferred embodiments of this invention has been presented for purposes of illustration and description. It is not intended to be exhaustive or to limit the invention to the precise form disclosed, and obviously, many modifications and variations are possible. Such modifications and variations that may be apparent to a person skilled in the art are intended to be included within the scope of this invention as defined by the accompanying claims.

What is claimed is:

1. A strapless and backless bra, comprising:

a) a first cup and a second cup, wherein each cup includes:
an open top end,
a closed bottom end,
an outer side and an inner side each having substantially parallel upper portions, and
a tab, positioned proximate the outer side; and b) wherein the upper portion of the inner side of the first cup is directly contacted with the upper portion of the inner side of the second cup.

2. The bra of claim 1, further comprising a cup connector for directly contacting the inner side of the first cup with the inner side of the second cup.

3. The bra of claim 1, further comprising a supporter, positioned to extend along the periphery of the closed end and the outer and the inner sides of each cup.

4. The bra of claim 1, wherein the supporter is rigid.

5. The bra of claim 1, wherein the bra is constructed from a soft woven fabric.

6. The bra of claim 1, wherein the bra is constructed from a knitted fabric.

7. The bra of claim 1, wherein each tab is positioned on one side of a body of a user.

8. The bra of claim 1, further comprising means for adhering the bra to a user.

9. The bra of claim 8, wherein the means for adhering the bra to the user comprises a two sided tape with a first side contacting the tab and a second side contacting one side of a body of a user.

10. The bra of claim 9, wherein the two sided tape has a first adhesive on the first side and a second adhesive on the second side.

11. The bra of claim 10, wherein the first adhesive is a random oriented, polyester fiber in a hypoallergenic, pressure sensitive acrylic adhesive.

12. The bra of claim 10, wherein the second adhesive is a hypoallergenic, pressure sensitive, acrylate adhesive.

13. A strapless and backless bra, comprising:

a first cup having an inner side, an outer side, an open top end, a closed bottom end and a tab positioned proximate the outer side, wherein the inner side and the outer side each have an upper portion that are substantially parallel to each other;

a second cup having an inner side, an outer side, an open top end, a closed bottom end and a tab positioned proximate the outer side, wherein the inner side and the outer side each have an upper portion that are substantially parallel to each other; and wherein the upper portion of the inner side of the first cup is directly contacted with the upper portion of the inner side of the second cup.

* * * * *